United States Patent [19]

Ikegaya

[11] 4,153,029

[45] May 8, 1979

[54] HEAT INSULATOR FOR A CARBURETOR

[75] Inventor: Seiji Ikegaya, Toyota, Japan

[73] Assignee: Toyota Jidosha Kogyo Kabushiki Kaisha, Japan

[21] Appl. No.: 850,617

[22] Filed: Nov. 10, 1977

[30] Foreign Application Priority Data

Aug. 2, 1977 [JP] Japan ..... 52-93090

[51] Int. Cl.[2] ..... F02M 29/14

[52] U.S. Cl. ..... 123/141; 48/180 M

[58] Field of Search ..... 123/141; 48/180 M, 180 B, 48/180 R

[56] References Cited

U.S. PATENT DOCUMENTS

| | | | |
|---|---|---|---|
| 1,509,742 | 9/1924 | Webber | 48/180 R |
| 1,512,952 | 10/1924 | Secor | 123/141 |
| 1,562,077 | 11/1925 | Bliffert | 48/180 R |
| 1,639,579 | 8/1927 | Telecsky | 48/180 R |
| 1,933,364 | 10/1933 | Chandler | 123/141 |
| 2,072,353 | 3/1937 | Ball | 48/180 R |
| 2,614,037 | 10/1952 | Linn | 48/180 R |
| 2,639,230 | 5/1953 | Lefebre | 48/180 R |
| 2,822,253 | 2/1958 | Caddock | 123/141 |
| 3,648,674 | 3/1972 | Proctor | 123/141 |
| 3,747,581 | 7/1973 | Kolb | 123/141 |
| 3,938,967 | 2/1976 | Reissmuller | 123/141 |
| 3,968,780 | 7/1976 | Konomi et al. | 123/141 |
| 4,019,483 | 4/1977 | Konomi et al. | 123/141 |
| 4,020,805 | 5/1977 | Konomi et al. | 123/141 |

FOREIGN PATENT DOCUMENTS

| | | | |
|---|---|---|---|
| 257793 | 3/1928 | Italy | 48/180 R |
| 276196 | 1/1930 | Italy | 48/180 R |
| 833190 | 4/1960 | United Kingdom | 48/180 R |

*Primary Examiner*—Tim R. Miles

*Attorney, Agent, or Firm*—Stevens, Davis, Miller & Mosher

[57] ABSTRACT

A heat insulator for a carburetor, wherein the intake opening of the heat insulator is made smaller than the throttle bore of the carburetor so that an annular shoulder portion is provided at the intake opening so that fuel flowing down as a film along the inner wall surface of the throttle bore is intercepted by the annular shoulder portion so as to make more uniform the distribution of fuel along the periphery of the intake opening, or to modify desirably the distribution of fuel along the periphery of the intake opening.

12 Claims, 9 Drawing Figures

HEAT INSULATOR FOR A CARBURETOR

BACKGROUND OF THE INVENTION

The present invention relates to a heat insulator for a carburetor, and more particularly to a heat insulator adapted to be mounted between a downflow type carburetor and an intake manifold.

In operation of a carburetor, the wall of a throttle bore of the carburetor is generally covered with a film of liquid fuel formed by the attachment of fuel droplets and the fuel film gradually flows along the wall surface of the throttle bore toward an intake manifold connected with the carburetor. However, the fuel film is generally not uniformly distributed around the periphery of the wall of the throttle bore, due to the effect of the direction of fuel ejection from the main and auxiliary fuel nozzles in the carburetor, the asymmetrical arrangement of the throttle valve, etc., whereby there occurs an unbalance in the fuel supply to individual cylinders caused by the fuel film flow which is conducted along the inner wall surface of the throttle bore and the intake manifold thereby causing an irregularity of air/fuel ratio between the various cylinders. In current engines the variation of air/fuel ratio between individual cylinders is relatively high, amounting, in some instances, to ±20% deviation from the mean value. Such an irregularity in the supply of fuel to individual cylinders causes various drawbacks such as poor engine efficiency, poor fuel consumption, increase of octane requirement and unstable operation in idling and low load conditions.

SUMMARY OF THE INVENTION

It is therefore the object of the present invention to improve the division of fuel supply to individual cylinders in a multi-cylinder engine having a carburetor with regard to the supply of fuel provided in the form of a fuel film conducted along the internal wall surface of the throttle bore and the intake manifold.

In accordance with the present invention, the above-mentioned object is accomplished by providing a heat insulator for a carburetor having a downdraft throttle bore, said heat insulator having an intake opening of a diameter which is smaller than that of said throttle bore so that an annular shoulder portion is provided at the joining boundary of said throttle bore and said intake opening.

By incorporating a heat insulator of the aforementioned structure between a carburetor and an intake manifold, liquid fuel which has flowed over the inner wall surface of the throttle bore is intercepted by the annular shoulder portion at the entrance to the intake opening of the heat insulator, whereby irregular distribution of the fuel around the periphery of the throttle bore is made more uniform by a transverse flow of fuel along the annular shoulder portion. Furthermore, when the fuel further flows onto the wall surface of the intake opening of the heat insulator over the edge of the annular shoulder portion, a blowing-off effect is applied to the fuel by the flow of intake air, whereby atomization and/or vaporization of the fuel is accelerated thereby further improving the division of fuel between the individual cylinders due to a reduction of the porportion of the fuel supplied in the form of a fuel film conducted along the inner wall surface of the intake passage.

According to a modification of the present invention, an annular shoulder portion inclined with respect to the plane of the joining faces of the carburetor and the heat insulator may be provided adjacent to said joining faces. Since in this case the fuel which has reached the annular shoulder portion is more liable to flow along said annular shoulder portion toward a particular portion thereof due to its inclination, if the particular portion of the annular shoulder portion is judiciously arranged with respect to the arrangement of the intake manifold, a desirable more uniform division of fuel between the individual cylinders may be accomplished.

According to another modification of the present invention, said intake opening of the heat insulator may further include an inversely arranged annular shoulder portion located downstream of said first-mentioned annular shoulder portion, and directly cut in the wall of the intake opening of the heat insulator. Such a cut-in type annular inverse shoulder portion may be inclined with respect to the plane of the face of the heat insulator. In this case, the fuel flowing over the wall surface of said intake opening after having rounded the edge of said annular shoulder portion is once again intercepted by said inverse annular shoulder portion due to the adhesion of the liquid onto the wall surface and is further caused to move transversely along the annular inverse shoulder portion. By judiciously arranging the annular inverse shoulder portion, the division of the fuel conducted along the wall surface of the intake manifold between the individual cylinders may be further desirably adjusted.

The present invention has an advantage that the improvement of fuel division between individual cylinders is obtained by applying a small modification to a heat insulator interposed between the carburetor and the intake manifold and that therefore it is easily applicable to existing engines at low cost.

BRIEF DESCRIPTION OF THE DRAWING

The present invention will become more fully understood from the detailed description given hereinbelow and the accompanying drawings which are given by way of illustration only and thus are not limitative of the present invention, and wherein.

DESCRIPTION OF THE PREFERRED EMBODIMENT

Figure 1:
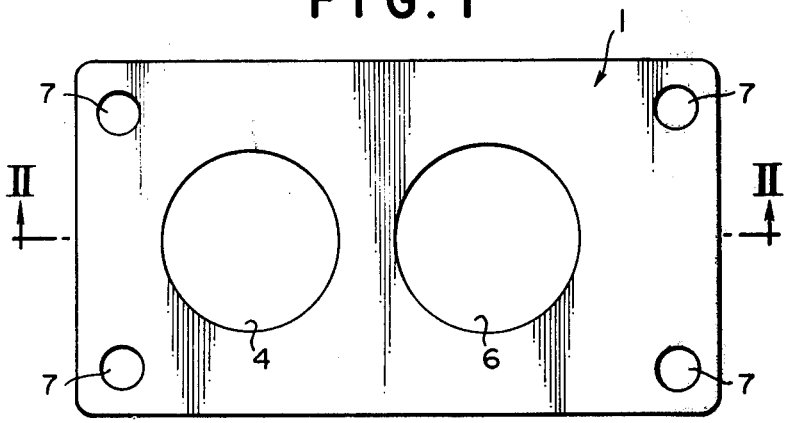
FIG. 1 is a plan view of an embodiment of the heat insulator according to the present invention.
Figure 2:
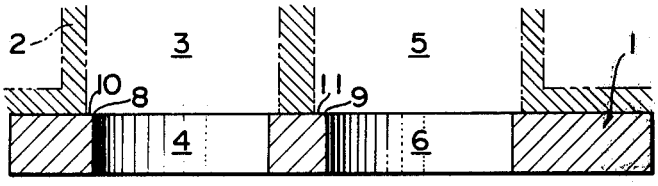
FIG. 2 is a sectional view along line II—II in FIG. 1.
Figure 3:
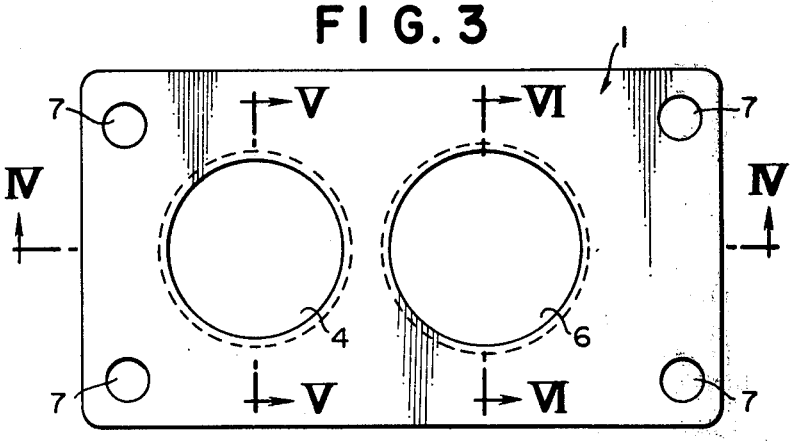
FIG. 3 is a plan view of another embodiment of the heat insulator according to the present invention.
Figure 4:
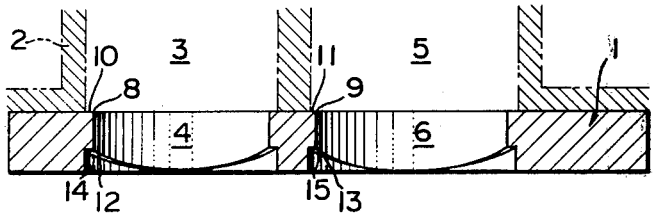
FIG. 4 is a sectional view taken along line IV—IV in FIG. 3.
Figure 5:
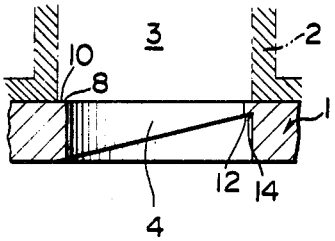
FIGS. 5 and 6 are sectional views along lines V—V and VI—VI in FIG. 3.
Figure 6:
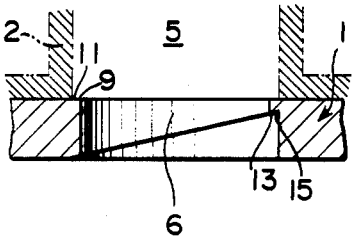

Referring to FIGS. 1 and 2, showing a basic embodiment of the heat insulator of the present invention, a heat insulator generally designated by 1 is formed as a heat insulator for a two-barrel type carburetor and is substantially a plate element made of a material having low heat conductivity such as phenol resin. The plate element has two intake openings 4 and 6 corresponding to a primary throttle bore 3 and a secondary throttle bore 5 of a two-barrel type carburetor 2 and also has four bolt holes 7 formed adjacent to four corners thereof. As is better shown in FIG. 2, the intake openings 4 and 6 are formed to have a diameter which is smaller than that of the throttle bores 3 and 5 by an amount of approximately 2–3 mm, and, because of this, annular shoulder portions 8 and 9 are formed at the joining boundaries of the throttle bores and the intake openings. The annular shoulder portions 8 and 9 include upwardly facing annular land faces 10 and 11, respectively. When fuel flows down as a film along the inner wall surface of the primary and secondary bores 3 and 5, the fuel flow is intercepted by the annular shoulder portions 8 and 9, or, more particularly, by the annular land faces 10 and 11, whereby if there exists an unbalanced distribution of fuel around the peripheries of the throttle bores, a transverse flow of fuel occurs along the annular land faces 10 and 11 thereby making more uniform the distribution of the fuel around the annular shoulder portions from which the fuel then further flows down along the inner walls of the intake openings 4 and 6 as a uniformly distributed film of fuel. Furthermore, when the fuel flows over the annular edges of the annular shoulder portions 8 and 9 as a film of fuel, the fuel is given an air cutting or blowing off effect by the flow of intake air, whereby atomization and/or vaporization of the fuel is accelerated.

FIGS. 3–6 show another embodiment of the heat insulator of the present invention. In these figures, the portions corresponding to those shown in FIGS. 1 and 2 are designated by the same reference numerals. In this embodiment the intake openings 4 and 6 are further formed with inversely arranged annular shoulder portions 12 and 13 which include downwardly facing annular land faces 14 and 15, respectively.

Furthermore, as shown in the figures, the annular inverse shoulder portions 12 and 13 are inclined with respect to the joining faces of the carburetor 2 and the heat insulator 1. The inclination of the annular inverse shoulder portions 12 and 13 is oriented to produce a certain desirable unbalanced flow of fuel around the inverse annular shoulder portions 12 and 13 which compensates for a certain unbalanced division of fuel to the individual cylinders inherent in the structure of the intake manifold so that the overall supply of fuel to the individual cylinders in the form of fuel suspended in a mist in the intake air and in the form of fuel flowing along the inner wall surface of the intake passages is more desirably balanced between the individual cylinders.

Figure 7:
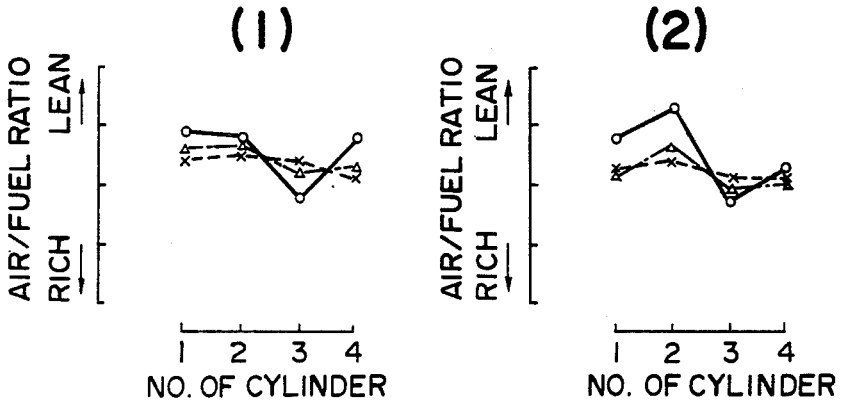
FIG. 7 shows graphs illustrating the results of experiments performed to ascertain the effect of the heat insulator of the present invention.

FIG. 7 shows graphs which illustrate the result of the division of fuel to the individual cylinders of a four cylinder engine. In FIG. 7, graph (1) shows the air/fuel ratio in the individual cylinders in high speed high load operation, while graph (2) shows the air/fuel ratio in the individual cylinders in low speed low load operation. In these two graphs the solid lines show the cases of employing a conventional heat insulator, dot-and-dash lines show the cases of employing a heat insulator of the type shown in FIGS. 1 and 2 of the present application, and broken lines show the cases of employing a heat insulator such as shown in FIGS. 3–6 of the present application. From these results it will be apparent that the heat insulator of the present invention, particularly the one as shown in FIGS. 3–6, substantially improves the balance in the division of fuel to the individual cylinders in a multi-cylinder engine.

Figure 8:
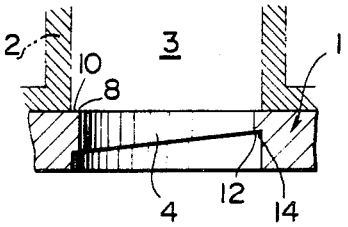
FIG. 8 is a sectional view showing a modification of the heat insulator shown in FIGS. 3–6.

FIG. 8 shows a modification of the heat insulator shown in FIGS. 3–6. In this modification, the inclination of the annular inverse shoulder portion 12 is smaller than that in the embodiment shown in FIG. 5, and the annular inverse shoulder portion 12 is located at an axially middle portion of the intake opening. The heat insulator shown in FIG. 8 provides a relatively moderate modification of a uniform distribution of fuel around the periphery of the intake opening when compared with the heat insulator shown in FIG. 5.

Figure 9:
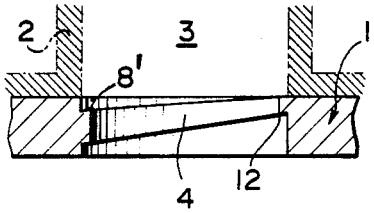
FIG. 9 is a sectional view showing still another modification of the heat insulator according to the present invention.

As another modification of the heat insulator of the present invention, an annular upwardly facing shoulder portion 8' such as shown in FIG. 9 may be directly cut in the wall of the intake opening 4 of the heat insulator 1. Furthermore, as shown in FIG. 9, such a cut-in type annular upwardly facing shoulder portion 8' may be combined with the annular inverse shoulder portion 12. When the annular upwardly facing and inverse shoulder portions are both inclined in the same direction, the heat insulator provides a relatively severe modification of a uniform distribution of fuel around the periphery of the intake opening.

Although the invention has been shown and described with respect to some preferred embodiments thereof, it should be understood by those skilled in the art that various changes and omissions of the form and detail thereof may be made therein without departing from the scope of the invention.

I claim:

1. In an internal combustion engine having an inlet manifold and a downdraft-type carburetor having a circular bore, a heat insulator, constructed of a material having a low heat conductivity, interposed and clamped between the carburetor and the inlet manifold, said heat insulator comprising a flat elongated body defining a circular intake opening of a diameter smaller than that of said carburetor bore so that an upper annular shoulder portion is provided at the joining boundary of said carburetor bore and said intake opening, said intake opening further including an inversely arranged annular shoulder portion located downstream of said upper annular shoulder portion and formed in the wall of said intake opening and having a downwardly facing annular land face which is inclined with respect to a plane perpendicular to the central axis of said intake opening.

2. The heat insulator of claim 1, wherein the diameter of said intake opening is smaller than that of said throttle bore by an amount of 2–3 mm.

3. The heat insulator of claim 1, wherein said two annular shoulder portions are inclined in the same direction with respect to a plane perpendicular to the central axis of said intake opening.

4. The heat insulator of claim 1, wherein said inversely arranged annular shoulder portion has a peripheral portion which substantially joins a lower peripheral portion of said intake opening.

5. The heat insulator of claim 1, wherein said inversely arranged annular shoulder portion is located at an axially middle portion of said intake opening.

6. The heat insulator of claim 1, wherein said intake opening further includes an inversely arranged shoulder portion located downstream of said first mentioned annular shoulder portion and cut in the wall of said intake opening.

7. The heat insulator of claim 6, wherein said inversely arranged annular shoulder portion is inclined with respect to a plane perpendicular to the central axis of said intake opening.

8. The heat insulator of claim 7, wherein said inversely arranged annular shoulder portion has a peripheral portion which substantially joins a lower peripheral portion of said intake opening.

9. The heat insulator of claim 7, wherein said inversely arranged annular shoulder portion is located at an axially middle portion of said intake opening.

10. In an internal combustion engine having an inlet manifold and a downdraft-type carburetor having a circular bore, a heat insulator, constructed of a material having a low heat conductivity, interposed and clamped between the carburetor and the inlet manifold, said heat insulator comprising a flat elongated body defining a circular intake opening of a diameter smaller than that of said carburetor bore, said intake opening including an upper annular shoulder portion which is formed in the wall of said intake opening and which has an upwardly facing annular land face which is inclined with respect to a plane perpendicular to the central axis of said intake opening.

11. The heat insulator of claim 10, wherein said shoulder portion is inclined with respect to a plane perpendicular to the central axis of said intake opening.

12. The heat insulator of claim 10, wherein said intake opening further includes an inversely arranged annular shoulder portion located downstream of said upper annular shoulder portion and formed in the wall of said intake opening and having a downwardly facing annular land face which is inclined with respect to a plane perpendicular to the central axis of said intake opening, said upwardly facing annular land face and said downwardly facing annular land face being substantially parallel.

* * * * *